US005423519A

United States Patent [19]

Connors, Sr.

[11] Patent Number: 5,423,519

[45] Date of Patent: Jun. 13, 1995

[54] REGENERATIVE CHAMBER LINING AND METHOD OF INSTALLATION

[75] Inventor: Charles W. Connors, Sr., Wilmette, Ill.

[73] Assignee: Magneco/Metrel, Inc., Addison, Ill.

[21] Appl. No.: 249,471

[22] Filed: May 26, 1994

[51] Int. Cl.[6] ..... C22B 1/00

[52] U.S. Cl. ..... 266/44; 264/30; 266/139; 266/280; 266/286

[58] Field of Search ..... 266/44, 139, 280, 281, 266/286; 264/30, 31, 33; 432/212, 180, 181, 182; 165/9.1, 9.4, 4

[56] References Cited

U.S. PATENT DOCUMENTS

| | | | |
|---|---|---|---|
| 401,088 | 4/1889 | Westman | 266/139 |
| 417,019 | 12/1889 | Gordon | 165/9.1 |
| 545,976 | 9/1895 | Ransome | 264/33 |
| 1,552,064 | 9/1925 | Lake | 249/62 |
| 1,592,616 | 7/1926 | Noyes et al. | 266/139 |
| 1,643,425 | 9/1927 | Summey | 64/317 |
| 1,656,312 | 1/1928 | Black | 266/139 |
| 1,678,976 | 7/1928 | Durfee | 266/139 |
| 1,710,931 | 4/1929 | Klein | 266/44 |
| 2,104,201 | 1/1938 | Koppers | 165/9.4 |
| 3,301,101 | 9/1940 | Welshans | 22/147 |
| 3,396,961 | 8/1968 | Farrington | 266/42 |
| 3,492,383 | 1/1970 | Heimgartner | 264/30 |
| 3,672,649 | 6/1972 | Allen | 263/46 |
| 3,703,348 | 11/1972 | Pivar | 425/173 |
| 3,743,187 | 7/1973 | Breunsbach | 239/489 |
| 3,885,016 | 5/1975 | Pivar | 264/269 |
| 3,916,047 | 10/1975 | Niesen | 428/35 |
| 4,078,292 | 3/1978 | Porter | 29/402 |
| 4,279,844 | 7/1981 | Danjyo et al. | 264/30 |
| 4,364,798 | 12/1982 | Costa | 202/267 R |
| 4,438,906 | 3/1984 | English | 266/44 |
| 4,442,050 | 4/1984 | Takuo | 264/30 |
| 4,469,309 | 9/1984 | Takashima et al. | 266/44 |
| 4,480,820 | 11/1984 | Zhukou et al. | 266/44 |
| 5,147,830 | 9/1992 | Banerjee et al. | 501/89 |

FOREIGN PATENT DOCUMENTS

| | | |
|---|---|---|
| 116722 | 7/1942 | Australia . |
| 0064863 | 11/1982 | European Pat. Off. . |
| 2435532 | 2/1976 | Germany . |
| 2512841 | 9/1976 | Germany . |
| 2659205 | 7/1977 | Germany . |
| 44-9646 | 5/1969 | Japan . |
| 57-72758 | 5/1982 | Japan . |
| 59-259465 | 9/1984 | Japan . |
| 60-167843 | 5/1985 | Japan . |
| 60-214296 | 7/1985 | Japan . |
| 63-154258 | 12/1988 | Japan . |
| 1415431 | 11/1975 | United Kingdom . |
| 1513210 | 6/1978 | United Kingdom . |
| 2105828 | 3/1993 | United Kingdom . |
| 751966 | 10/1982 | U.S.S.R. . |
| 85/02397 | 6/1985 | WIPO . |

OTHER PUBLICATIONS

United States Steel, "*The Making, Shaping And Treating Of Steel*", 10th ed., (Dec. 1985), pp. 557–561.

Spec Data: Stay-Form For Poured-In-Place Concrete, Alabama Metal Industries Corp. (Dec. 1989).

*Primary Examiner*—Scott Kastler

*Attorney, Agent, or Firm*—Maxwell J. Petersen; Willian Brinks Hofer Gilson & Lione

[57] ABSTRACT

A continuous checker column is molded and formed in situ inside a regenerative chamber, thereby eliminating the need for large numbers of individual, preformed checker bricks. A plurality of rigid molding rods or flexible cable rods are passed through, or hang from, a template installed in or above the empty checker chamber portion of a regenerative chamber. The molding rods are sized, shaped, and spaced to correspond substantially to the size, shape and spacing of the openings desired in the checker column. Then, a refractory material is injected into the checker column and allowed to harden. The molding rods are at least partially retracted, leaving the desired openings in the hardened refractory material. The injection and retraction steps can be repeated, as necessary, until the entire checker column has been formed.

19 Claims, 6 Drawing Sheets

REGENERATIVE CHAMBER LINING AND METHOD OF INSTALLATION

FIELD OF THE INVENTION

This invention relates to a refractory lining for a hot air regenerative chamber, for example, a regenerative chamber for a blast furnace stove. This invention also includes a method of installing the refractory lining in a hot air regenerative chamber.

BACKGROUND OF THE INVENTION

Industrial furnaces including, for example, blast furnaces used in the iron and steel industry, require very high temperatures during operation. In order to achieve these temperatures, which may exceed 3,000° F., some preheating of the air entering the furnace is often required. This preheating is typically accomplished using a chamber separate from the furnace, called a "regenerative chamber" or "stove." These stoves are tall, cylindrical steel structures insulated with refractory and mostly filled with refractory checker bricks where heat is stored and then transferred to the air entering the blast furnace. Each stove also includes a combustion chamber used to preheat air before it passes through the refractory checker bricks. Each stove can also operate in a reverse mode wherein combustion is stopped and exhaust air from the furnace passes through the stove.

Referring to FIG. 1, a conventional regenerative chamber 10 is shown in vertical cross-section. The stove 10 includes an outer steel shell 12, and an inner refractory shell 14, both of which are typically cylindrical in shape. The stove 10 also includes a semi-spherical dome-shaped top 16, and a steel/concrete base 18. The refractory shell 14 substantially covers the sides and dome of the stove 10, and is typically constructed of fireclay, high alumina and/or mullire brick.

The inside of the oven 10 includes a combustion chamber 15 and a checker chamber 20. The combustion chamber 15 is lined on its sides by a heavy duty insulating liner 17, typically constructed from alumina brick. During the preheating operation, air enters the combustion chamber 18 through an air inlet 22. The combustion chamber 15 is heated by a burner (not shown) which communicates with the combustion chamber 15 via a separate combustion inlet 24. Air which enters through the inlet 22 is heated and is caused to rise through the chamber 18 into the dome region 26 of the stove 10, whereupon the hot air passes down through the checker chamber 20 and exits through an outlet 30 which communicates with a furnace (not shown). The dome 16 defines the dome region 26, and includes a manhole 28 at its top, which is typically plugged during operation of the stove 10.

FIG. 2 is a sectional view of the stove 10 from just above the combustion chamber and the checker chamber. As shown therein, the majority of the stove 10 is occupied by the checker chamber 20, with the ovular combustion chamber 15 occupying only a minor portion of the stove 10. Also, the refractory liner 14 forms a first wall 23 inside the checker chamber 20, and a second wall 25 surrounding the combustion chamber 15. The combustion chamber 15 is also defined by a separate shell 27.

In the prior art, the checker chamber 20 has been filled from top to bottom with a checker column 21 composed of many layers of checker bricks constructed from a high temperature-resistant refractory material, for example, mullire, high alumina, fireclay, andalucite, or a combination of the foregoing. The checker bricks are available in a wide variety of configurations, for example, the checker bricks 32, 34 and 36 shown in perspective in FIGS. 4, 5 and 6.

The checker bricks include a large number of openings 38 which, in FIG. 2, have been enlarged to simplify the later illustration of the invention. In the checker chamber 20, the checker bricks are placed side by side and in layers, with the layers being lined up so that the openings 38 coincide throughout the length of the checker column 21. Hot air from the combustion chamber 15 passes down through the openings 38 in the checker column 21, causing the checker bricks to heat up and reach a steady state high temperature distribution, assuring a generally uniform temperature for preheated air passing into the furnace from the checker chamber 20 through the outlet 30.

A typical blast furnace is simultaneously connected to three regenerative stoves 10. At any given time, two of the stoves 10 are set up for the forward (preheat) operation and one of the stoves 10 is set up for the reverse (exhaust) operation. During the exhaust operation, the combustion burner is deactivated and the flow through the stove 10 is reversed. Exhaust gases from the furnace enter the stove 10 through the port 30 and rise through the checker column 21, gradually resulting in the cooling of both the exhaust gases and the checker bricks. The exhaust gases then rise into the dome region 26, pass down through the deactivated combustion chamber 15, and exit via the port 22.

As shown in FIG. 1, and more clearly in FIG. 3, the checker column 21 is supported by a porous plate 40 which, in turn, is supported by a rim 41 and a plurality of steel columns or beams 42. Except for the region occupied by the plate 40, rim 41 and beams 42, the checker column 21 occupies substantially the entire height of the stove 10, and also occupies most of its cross-section. Referring to FIG. 1, the height of the checker column 20 may be on the order of 130 feet for a typical blast furnace stove. Referring to FIG. 2, the checker column diameter (left to right) may exceed 30 feet. The diameter of the checker openings 38, by comparison, is typically less than six inches, and the depth of a single checker brick (FIGS. 4–6) is typically about 4–7 inches. Therefore, a very large number of individual checker bricks, positioned in a very large number of layers, are needed to fill a checker chamber 20.

Periodically, the checker bricks in the checker chamber 20 wear out and need to be replaced. Replacement of these checker bricks has been a very labor-intensive, capital-intensive and time consuming process. When replacing the checker bricks, or when installing checker bricks in a new regenerative chamber 10, the checker bricks must be laid out side by side, layer upon layer, until the checker chamber is full. This installation of checker bricks may require several weeks of time and a large quantity of individual, precision-molded, refractory checker bricks.

In order to reduce the cost of relining the checker columns in blast furnace stoves and other regenerative chambers, there is a need or desire for a method which requires less down time and less labor. There is also a need or desire for a checker column which does not require the purchase of large quantities of individual, precision-molded checker bricks and which is, therefore, less expensive, without sacrificing performance.

SUMMARY OF THE INVENTION

The present invention is a regenerative chamber lining, especially a checker column, which is molded in situ in the checker chamber portion of a regenerative chamber or stove. The present invention is also a method of installing a regenerative chamber lining, especially a checker column, which includes the step of molding the lining in situ in the checker chamber.

A plurality of rigid or flexible rods or cables are hung from a template or other support plate located in the checker chamber, or above the checker chamber. The lateral dimensions (e.g. diameters) of the rods correspond to the dimensions of the openings desired in the checker column, and the spacing between the rods corresponds to the desired spacing between the openings in the checker column. Initially, the rods extend to the bottom of the checker chamber, and may be temporarily connected to the support plate.

The hanging rigid or flexible rods cooperate with the support device and the sides of the checker chamber to serve as a mold for the checker column. A refractory material is then pumped into the checker chamber, and is allowed to fill a bottom portion of the chamber. The refractory material is allowed to harden or "set", so that the rods or cables may be at least partly retracted to the next higher level in the chamber, leaving the desired checker openings in the spaces previously occupied by the rods or cables.

Then, the refractory material is pumped into the next higher level of the checker chamber, wherein the rods or cables again serve as molds for the formation of checker column openings. The refractory material is again allowed to harden or set, and the rods or cables are again partially retracted to a higher level in the checker chamber. This process is repeated until the entire checker column has been molded and formed, with a continuous set of checker openings in the spaces previously occupied by the rods or cables.

After the lowermost portion of the column has been formed, the support plate and rods are disconnected from each other so that the rods may be retracted. The checker column produced from this process is continuous and monolithic in the horizontal direction, meaning that separate, discrete checker bricks are not present. The checker column may also be continuous and monolithic in the vertical direction, although different refractory materials may be used at different elevations in the column, as they are now. The checker column of the invention may be constructed from any suitable pumpable refractory material or combination of materials.

With the foregoing in mind, it is a feature and advantage of the invention to provide a regenerative chamber lining, especially a checker column, which requires substantially less time to install than conventional linings.

It is also a feature and advantage of the invention to provide a regenerative chamber lining, especially a checker column, which functions the same as conventional linings without requiring large quantities of discrete, precision-molded checker bricks.

It is also a feature and advantage of the invention to provide a regenerative chamber lining which is continuous and monolithic in the horizontal direction, and which is continuous and unbroken in the vertical direction, inside a checker chamber.

It is also a feature and advantage of the invention to provide a method of installing a regenerative chamber lining which includes the step of molding the lining in situ inside a checker chamber.

It is also a feature and advantage of the invention to provide a method of installing a regenerative chamber lining which is much less labor intensive and much less capital intensive than conventional methods.

The foregoing and other features and advantages of the invention will become further apparent from the following detailed description of the presently preferred embodiments, read in conjunction with the accompanying drawings. The detailed description and drawings are merely illustrative rather than limiting, the scope of the invention being defined by the appended claims and equivalents thereof.

DETAILED DESCRIPTION OF THE PRESENTLY PREFERRED EMBODIMENTS

Figure 1:
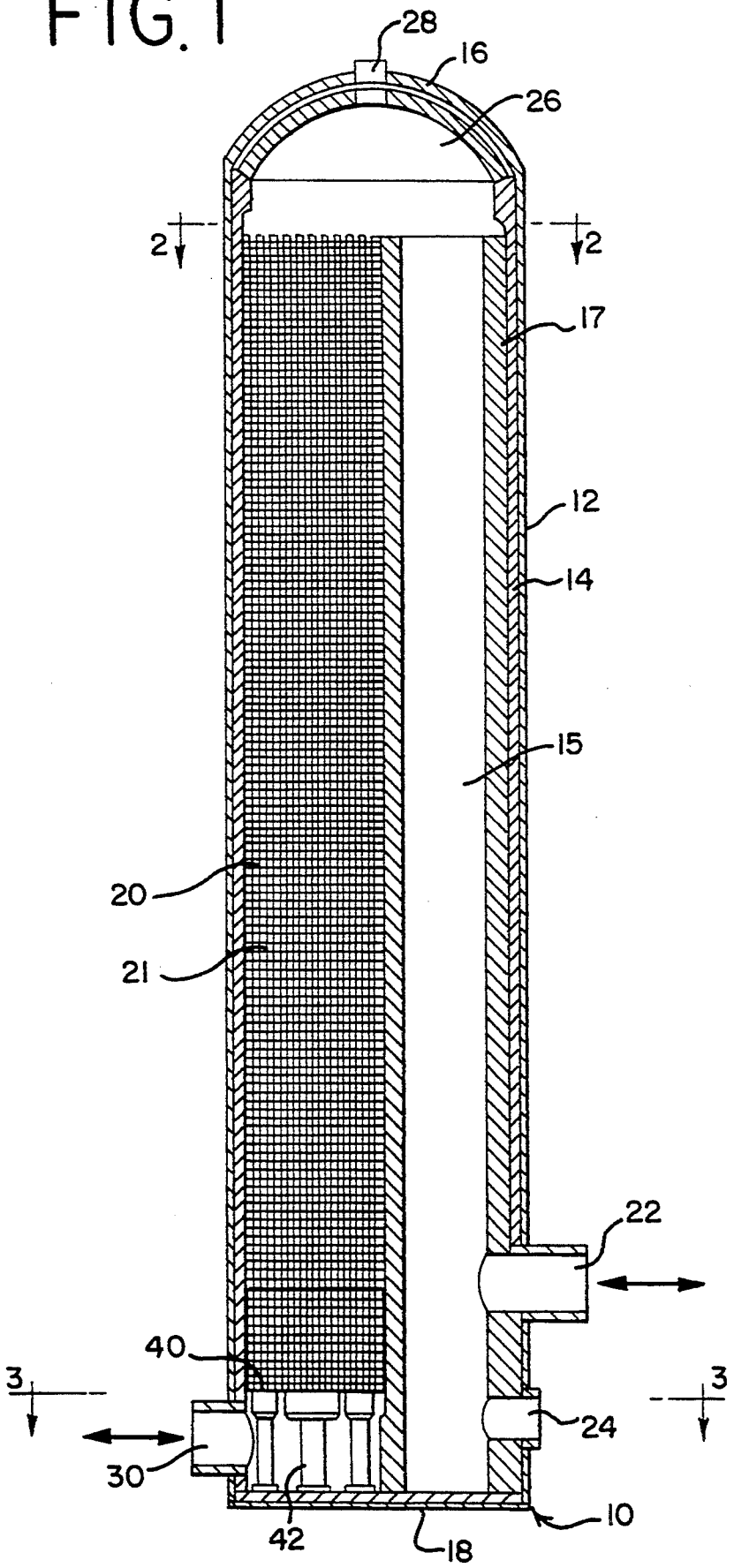
FIG. 1 (described above) is a vertical sectional view of a regenerative chamber, as known in the prior art.
Figure 3:
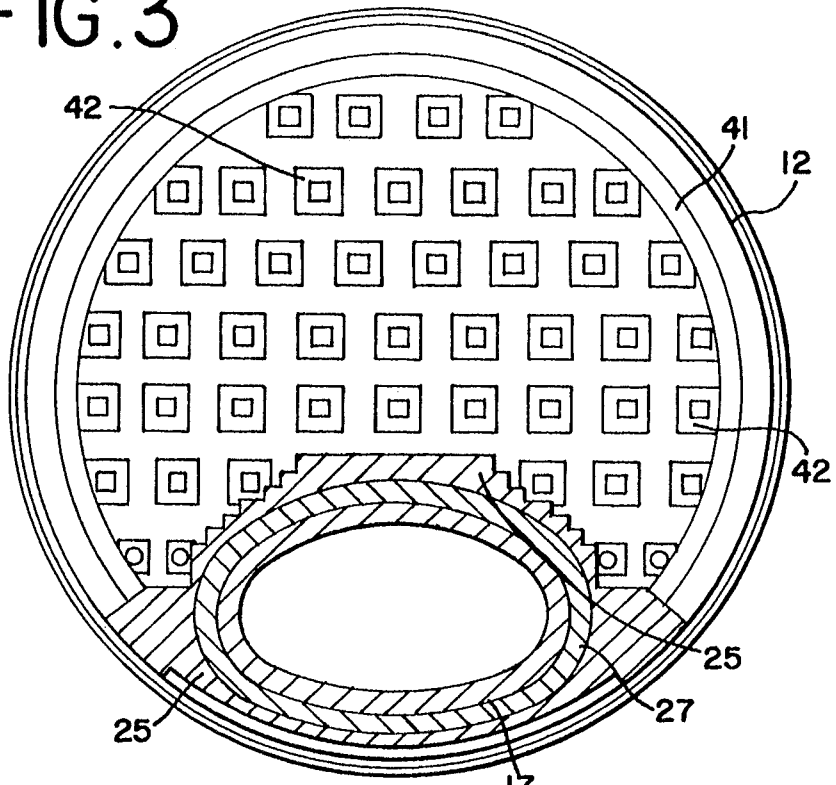
FIG. 3 (described above) is a top sectional view of the conventional regenerative chamber, taken along the line 3—3 in FIG. 1.
Figure 2:
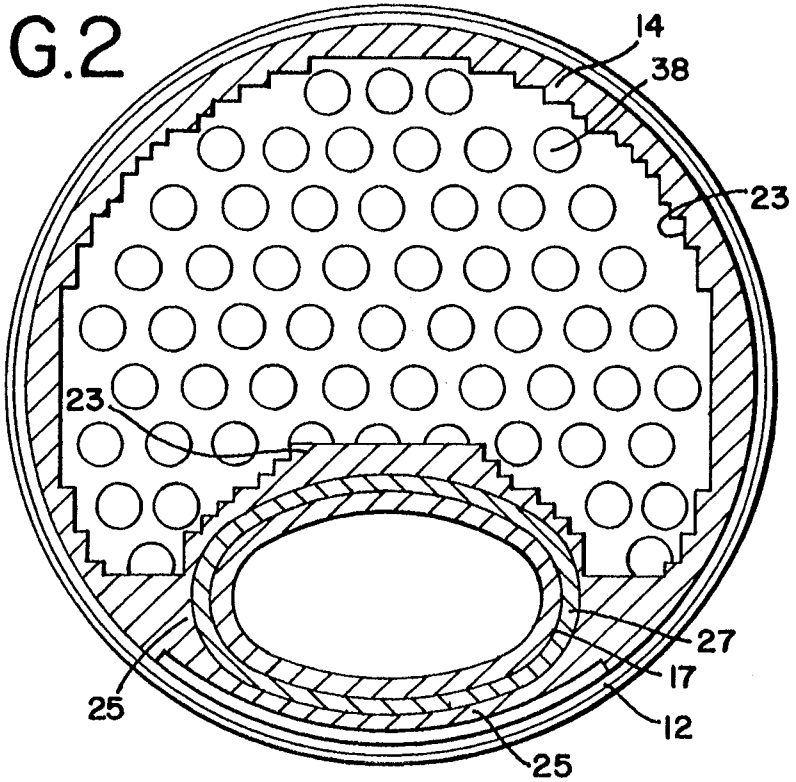
FIG. 2 (described above) is a top sectional view of the conventional regenerative chamber, taken along the line 2—2 in FIG. 1.
Figure 6:
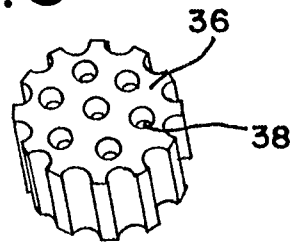
FIG. 6 (described above) is a perspective view of another conventional checker brick for a checker column.
Figure 5:
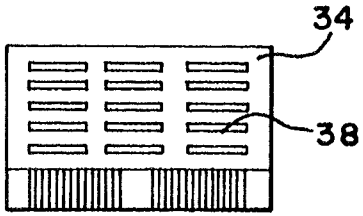
FIG. 5 (described above) is a perspective view of another conventional checker brick for a checker column.
Figure 4:
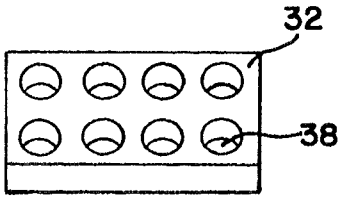
FIG. 4 (described above) is a perspective view of a conventional checker brick for a checker column.
Figure 7:
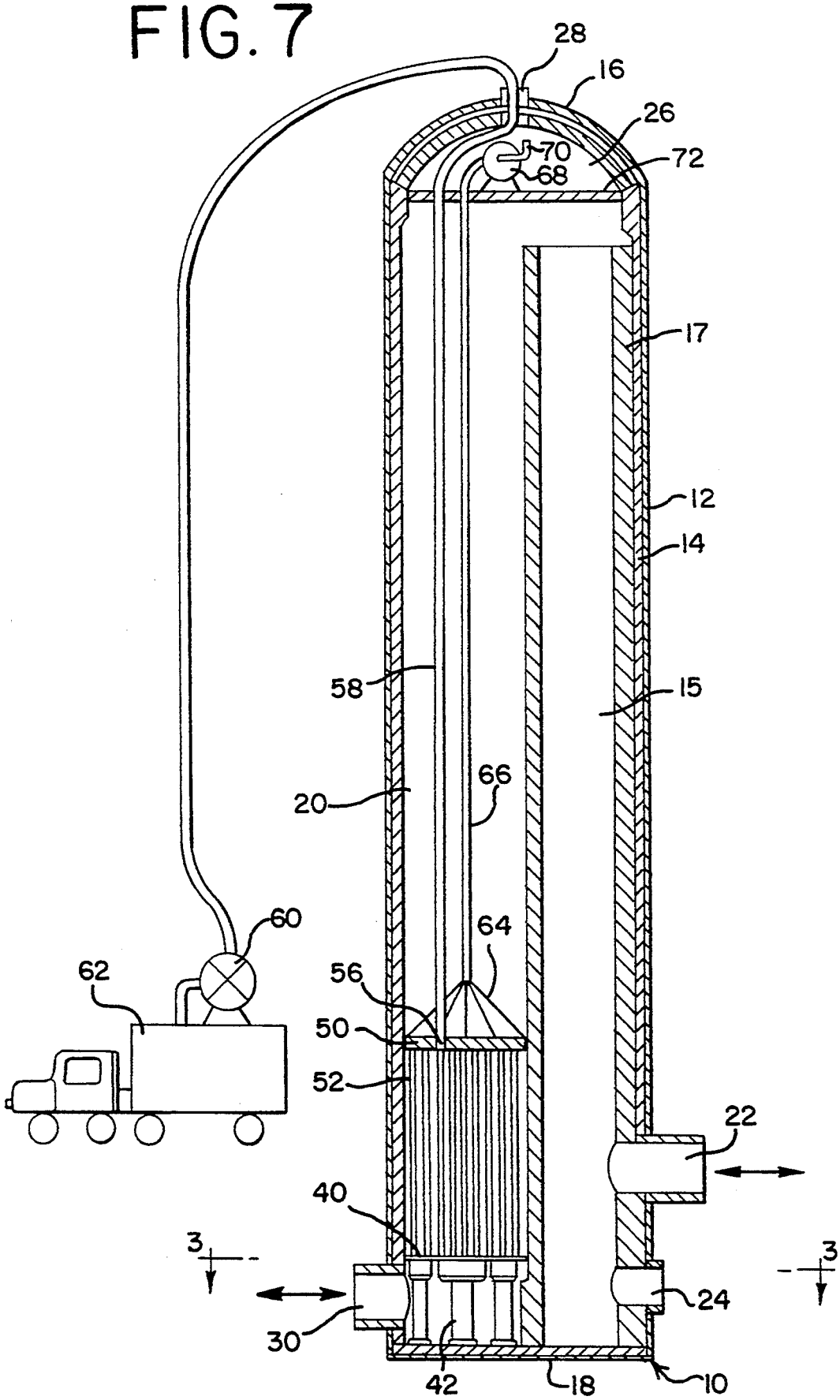
FIG. 7 is a sectional view of a regenerative chamber illustrating the relining of a checker chamber using a movable steel template, a plurality of molding rods hanging from the template, and a pumpable refractory composition.

The description of FIGS. 1–6 provided above, which relates to the structure of a conventional regenerative chamber or stove, is incorporated herein by reference. Referring to FIG. 7, a regenerative stove is shown including a checker chamber which is empty and which is ready for relining with a checker column. Initially, a portable template 50 having a plurality of molding rods or cables 52 mounted thereto and hanging therefrom, is installed near the bottom of the checker chamber 20 so that the molding rods or cables 52 communicate with the porous support plate 40 at the bottom of the checker column. The molding rods 50 and 52 must be of a size, shape and spacing which corresponds substantially to the size, shape and spacing of the openings desired in the checker column, for example, openings 38 such as shown in FIG. 2.

The molding rods 52 may be constructed from a partly compressible rigid material, for example, aluminum or steel rods coated with a compressible rubber layer, or polytetrafluoroethylene, or another suitable material. The rods may also be constructed from a partly compressible flexible material, for example, steel cables coated with rubber, high strength rubber cables, or link chains coated with rubber or plastic to provide a uniform outer surface.

The reason for using rods which are at least partly compressible, is that the rods 52 serve as molds for the refractory material used to construct the checker column. The refractory material, once installed, must be allowed to harden or set for a time before the rods 52 are refracted. This hardening or setting causes the refractory material to contract somewhat. Therefore, if the rods 52 were completely incompressible, they may be extremely difficult to remove from the hardened refractory material. The use of rods 52 which are at least partly compressible facilitates retraction of the rods.

Figure 10:
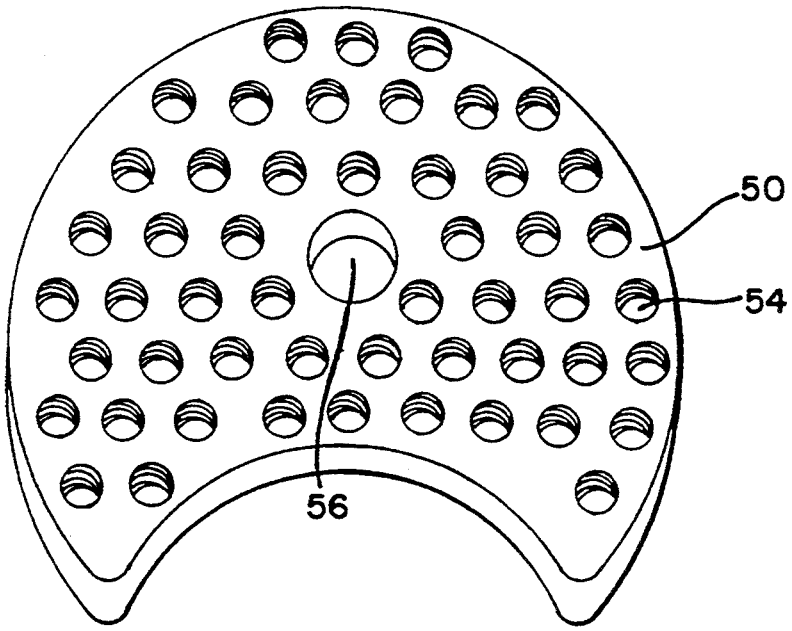
FIG. 10 is a lower perspective view of a movable template similar to the one shown in FIG. 8.

The lower ends of the rods 52 may be temporarily fastened, or releasably engaged, to the support plate 40 in order to maintain proper alignment during the initial stage of the checker column formation. The upper ends of the rods 52 are firmly mounted to the template 50. As shown in FIG. 10, the steel template 50 may include a plurality of threaded openings 54 for the mounting of the molding rods 52. The threaded openings 54 may pass only partially or entirely through the template 50, and the rods 52 may pass through the template 50 and be bolted on the other side. Of course, other techniques may also be employed for mounting the rods 52 to the template 50.

The template 50, which can be shaped to correspond to the cross-section of the checker chamber 20 (FIGS. 2, 10) also includes a larger feed opening 56 which is used to transmit a pumpable refractory material from above the template 50 to the spaces between the molding rods 52. As shown in FIG. 7, the feed opening 56 communicates with a flexible feed pipe 58 extending above the template 50, up through the manhole 28, and back down to a pump 60 and a refractory feed source such as the truck 52. A suitable pumpable refractory material can be based on alumina, clay, mullire, or any other refractory material which has been developed with a consistency suitable for pumping. One suitable refractory material is commercially available under the trade name METCAST, from Magnecol/Metrel, Inc. of Addison, Ill. Other suitable pumpable refractory materials are described in U.S. Pat. No. 5,147,830, the disclosure of which is incorporated herein by reference. Different pumpable refractory materials can be used at different stages of the chamber relining process, to form layers, as needed.

Referring again to FIG. 7, the upper surface of the template 50 is joined with a plurality of connector cables 64 which converge into a strong flexible support cable 66. The connector cables 64 may be joined to the template 50 using bolts, hinges, or any suitable fastening means. The support cable 66 originates from a reel 68 which can be manually operated using a crank 70, or which can be motor driven. The reel 68 can be mounted to a permanent or temporary guide plate 72 inside the dome 26 of the regenerative chamber 10, or can be mounted external to the regenerative chamber 10.

In accordance with the invention, the template 50 and molding rods 52 are initially lowered to the bottom of the checker chamber as shown in FIG. 7, by unwinding the reel 68. Then, the pumpable refractory material from the source 62 is transmitted via the pump 60, the flexible pipe 58 and the feed opening 56 into the space below the template 50. The template 50, support plate 40, molding rods 52 and chamber wall 23 (FIG. 2) act as a mold for the formation of the checker column as the space below the template 50 is filled with pumpable refractory material.

Next, the pumpable refractory material is permitted to harden or set for a period of time. Preferably, the pumpable refractory material includes a room temperature or low temperature binder, for example, colloidal silica and/or calcia aluminate cement, with or without fumed silica. If one of these binders is used, sufficient hardening or setting should occur in about 30 minutes to a few hours.

Figure 8:
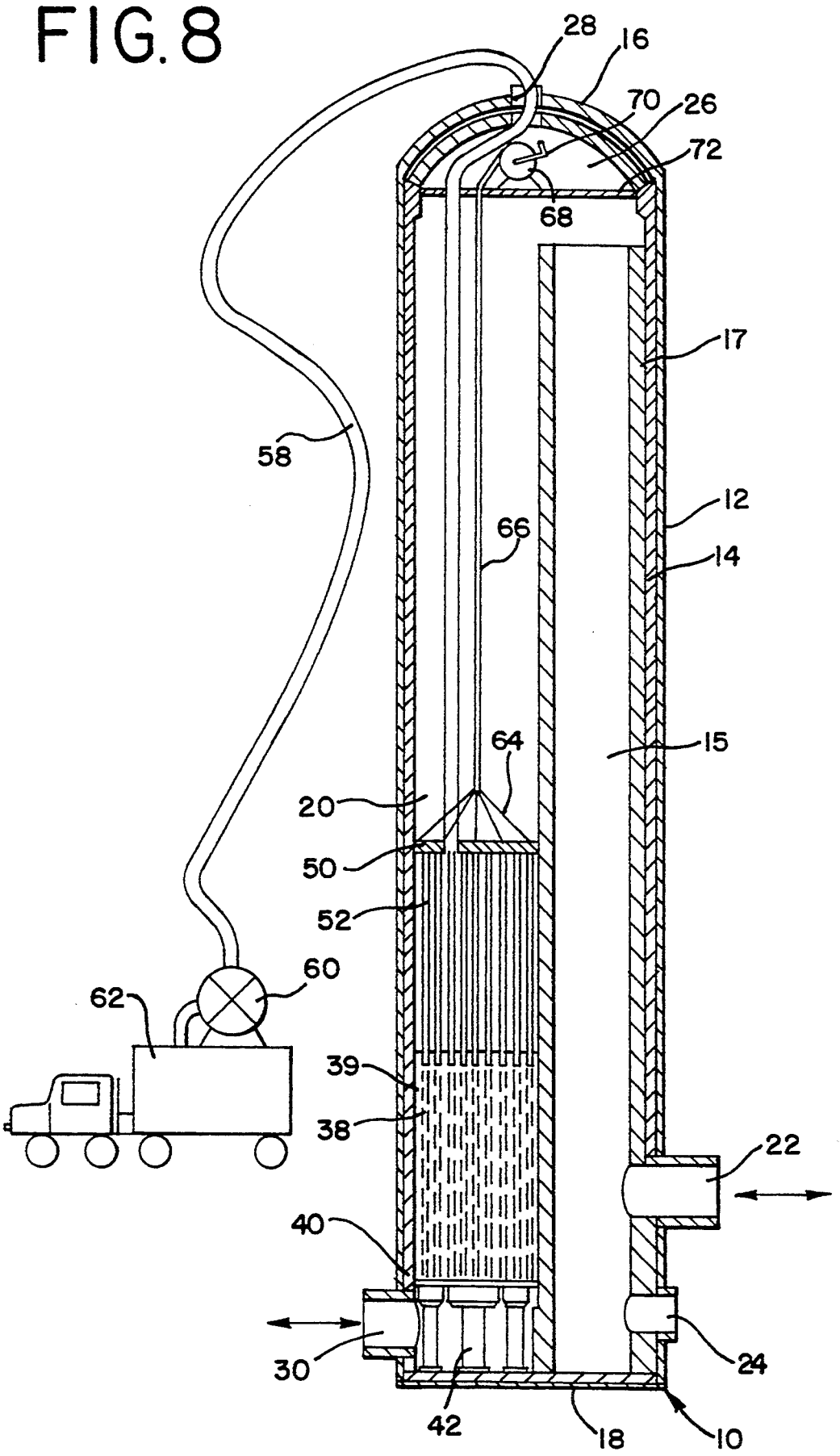
FIG. 8 corresponds to FIG. 7 except that the movable template has been moved to a higher elevation in the checker chamber after the lower portion of the checker chamber was relined with the pumpable refractory material.

Next, the template 50 and molding rods 52 are partially retracted by winding the support cable 66 onto the reel 68. As illustrated in FIG. 8, the hardened refractory material 39 is left with checker openings 38 in the locations previously occupied by the rods 52. The template 52 should be retracted only so far that the lower ends of the rods 52 remain embedded in the hardened refractory 39, in order to ensure that the spacing and alignment of the rods 52 does not change.

Next, with the template 50 and rods 52 positioned as shown in FIG. 8, the pumpable refractory material is again transported to the space below the template 50 until the space is filled. After the refractory material sufficiently hardens, the template 50 and rods 52 are partially retracted again by winding the cable 66 onto the reel 68. The foregoing steps are repeated until the hardened refractory material 39 with the checker openings 38 fills the entire checker chamber 20, thereby forming a continuous, unbroken checker column.

The checker openings 38 formed in accordance with the invention may be of the same dimensions as those found in the prior art (e.g. about 2–6 inches), or may be larger or smaller, depending on the requirements of the specific applications. However, unlike the prior art, the hardened refractory material 39 forming the checker column is continuous and monolithic (i.e. unbroken except for the checker openings) when viewed from a horizontal perspective taken through any section of the checker column. When viewed from a vertical perspective, the checker column of the invention is also continuous and unbroken, except for the checker openings, and may be monolithic depending on whether the same or different pumpable refractory materials are used at different elevations in the column.

Figure 9:
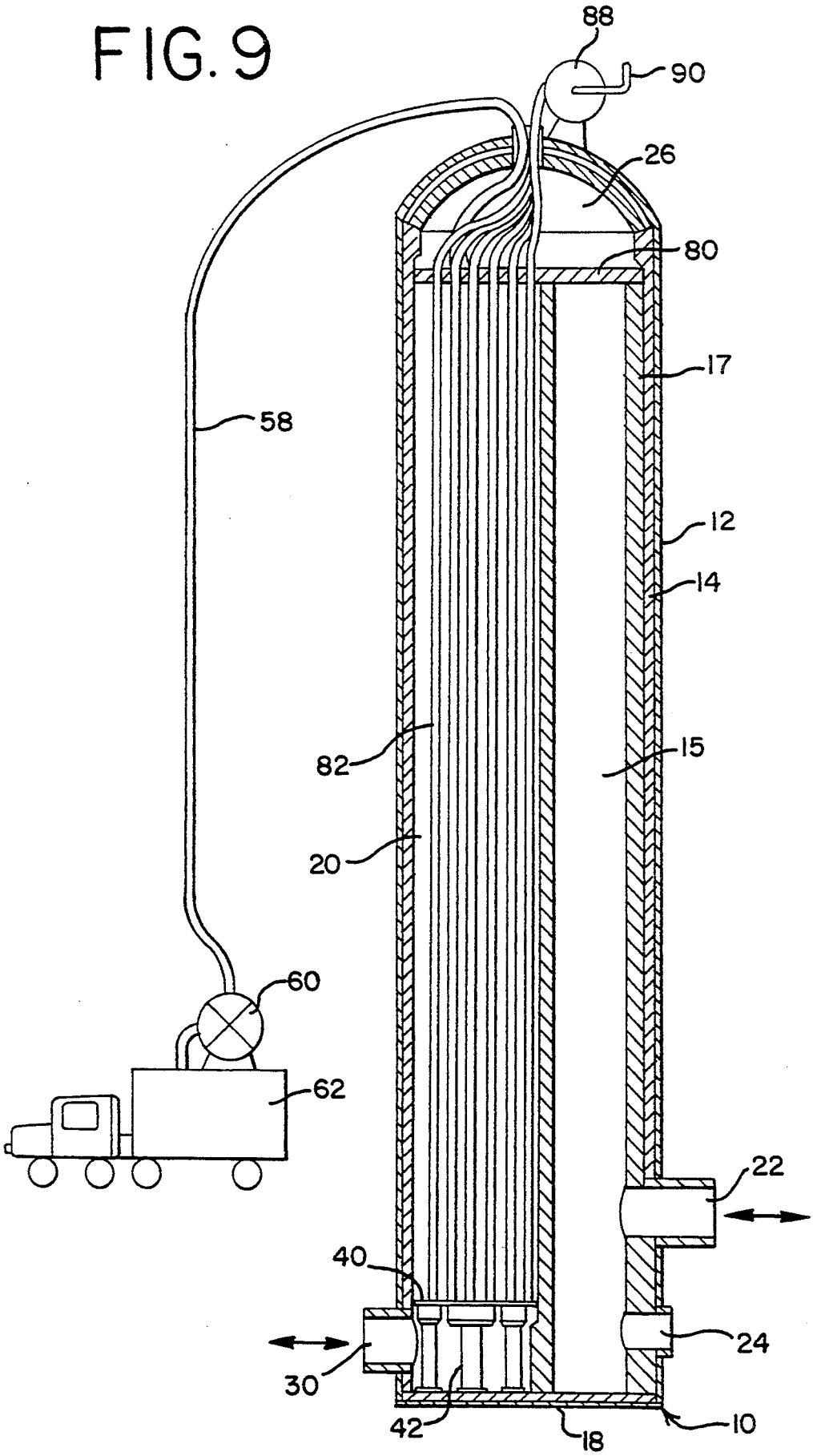
FIG. 9 is a sectional view of a regenerative chamber illustrating the relining of a checker chamber using a stationary template, a plurality of long molding cables passing through the template, and a pumpable refractory composition.
Figure 11:
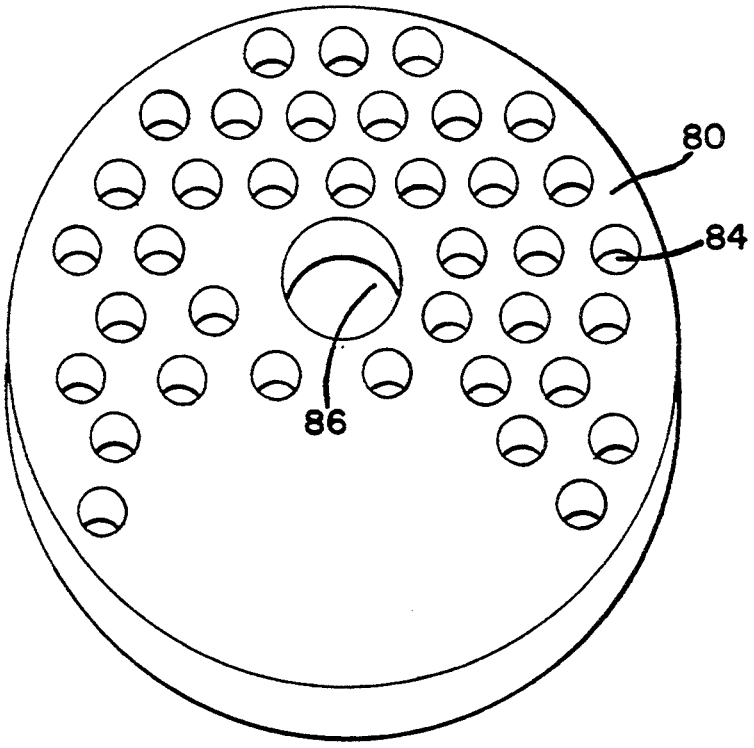
FIG. 11 is a lower perspective view of a stationary template similar to the one shown in FIG. 9.

FIG. 9 illustrates an alternative embodiment for making the continuous regenerative chamber lining of the invention. Instead of using a movable template, only a single stationary template 80 is mounted above the checker chamber. The stationary template 80 has a plurality of openings 84 which, as shown in FIG. 11, must pass through the template. The template 80 also has a larger feed opening 86.

A plurality of flexible molding cables 82 originate from a reel 88 (or, alternatively, a plurality of reels) whose winding and unwinding is controlled from a crank 90 (or, alternatively, a plurality of cranks, or one or more drive motors). In the embodiment shown, the reel 88 is external to the regenerative stove 10, and is supported on the dome 16, with the cables 82 passing through the manhole 28. The flexible cables 82 extend through the template 80 and, initially, to the bottom of the checker chamber 20, where they are temporarily and releasably connected to the porous support plate 40.

To perform the method of the invention using the embodiment of FIGS. 9 and 11, a pumpable refractory material from a source 62 is transmitted via pump 60 to a flexible feed pipe 58 which communicates with the feed opening 86 in the stationary template 80. The refractory material is allowed to fill the lowermost portion, for example, the lowest 20–30 feet of the checker chamber 20. After the refractory material hardens, the cables 82 are partially retracted by winding the reel 88 (or plurality of reels), leaving checker openings in the hardened refractory material. Then, the next higher portion of the checker chamber is filled with pumpable refractory material, the refractory material is allowed to harden, and the cables 82 are retracted again.

The above steps are repeated until the entire checker column has been installed. Using this embodiment, the template 80 serves only as a guide whose openings 84 slidably engage the molding cables 82. Unlike the embodiment of FIGS. 7–8 and 10, the template 80 does not otherwise support the cables 82. Other variations of the invention may also be practiced, leading to the same inventive result of a continuous regenerative chamber lining, unbroken except for the checker openings, with the entire lining (including the checker openings) being efficiently formed in situ inside a regenerative chamber.

While the embodiments of the invention disclosed herein are presently considered to be preferred, various modifications and improvements can be made without departing from the spirit and scope of the invention. The scope of the invention is indicated in the appended claims, and all changes that come within the meaning and range of equivalents are intended to be embraced therein.

I claim:

1. A method of lining a regenerative chamber with a checker column which includes a plurality of openings permitting passage of gas through the column, comprising the steps of:

a) positioning a plurality of molding rods upright in the regenerative chamber, the molding rods being sized, shaped and spaced to correspond substantially to the openings in the checker column to be formed;

b) filling at least a portion of the regenerative chamber with a pumpable refractory material, in the spaces between the molding rods;

c) permitting the refractory material to harden; and d) retracting the molding rods at least partially from the hardened refractory material.

2. The method of claim 1, further comprising the step of repeating steps b) thru d) until the checker column has been completely formed.

3. The method of claim 1, further comprising the step of temporarily fastening the molding rods to a lower end of the chamber being lined.

4. The method of claim 1, further comprising the steps of providing a movable template connected to the molding rods, and retracting the template with the molding rods.

5. The method of claim 1, further comprising the step of providing a stationary template having openings through which the molding rods pass.

6. The method of claim 1, wherein the molding rods comprise a metal coated with a compressible material selected from the group consisting of rubber and plastic.

7. The method of claim 1, wherein the molding rods comprise a metal.

8. The method of claim 1, wherein the molding rods comprise flexible cables selected from the group consisting of steel cables coated with rubber, rubber cables, and coated link chains.

9. The method of claim 4, further comprising the step of injecting the refractory material through a feed opening in the template.

10. The method of claim 5, further comprising the step of injecting the refractory material through a feed opening in the template.

11. The method of claim 1, further comprising the step of pumping the refractory material from a source to the regenerative chamber.

12. A checker column formed according to the method of claim 1, continuous and unbroken except for the openings.

13. A method of forming a checker column in situ in a regenerative chamber, comprising the steps of:

a) providing an empty checker chamber having a support device for a checker column to be installed, and at least one wall;

b) inserting a plurality of spaced apart molding rods into the checker chamber;

c) filling at least a portion of the checker chamber with a pumpable refractory material; and d) molding the refractory material in situ using the molding rods and wall.

14. The method of claim 13, further comprising the step of repeating steps c) and d).

15. A combination including a regenerative chamber and a checker column formed according to the method of claim 13, wherein the checker column is continuous and unbroken except for checker openings formed therein.

16. A combination including a regenerative chamber and a refractory checker column formed therein, the checker column comprising a plurality of checker openings permitting the passage of gas through the column, the checker column being substantially free of separate and discrete bricks in a horizontal direction, and unbroken except for the openings.

17. The combination of claim 16, wherein the refractory checker column is continuous in a vertical direction, and unbroken except for the checker openings.

18. The combination of claim 16, wherein the refractory checker column is continuous and monolithic in a vertical direction.

19. The combination of claim 16, wherein the refractory checker column is continuous in the vertical direction and comprises different refractory materials at different levels in the column.

* * * * *

UNITED STATES PATENT AND TRADEMARK OFFICE

CERTIFICATE OF CORRECTION

PATENT NO. : 5,423,519
DATED : June 13, 1995
INVENTOR(S) : Charles W. Connors, Sr.

It is certified that error appears in the above-indentified patent and that said Letters Patent is hereby corrected as shown below:

On the Title Page

In column 1, line 11, under "References Cited U.S. PATENT DOCUMENTS", delete "3,301,101" and substitute --2,301,101--.

In column 2, lines 1-2 of the "ABSTRACT", delete "in situ" and substitute --*in situ*--.

Column 8

In claim 13, line 1, delete "in situ" and substitute --*in situ*--.

In claim 13, line 10, delete "in situ" and substitute --*in situ*--.

Signed and Sealed this

Second Day of July, 1996

*Attest:*

*Attesting Officer*

BRUCE LEHMAN

*Commissioner of Patents and Trademarks*